US008127949B2

(12) United States Patent
Walker et al.

(10) Patent No.: US 8,127,949 B2
(45) Date of Patent: Mar. 6, 2012

(54) CRANE BACKSTAY SPREADER

(75) Inventors: Robert J. Walker, Manitowoc, WI (US); Daniel L. Krajnik, Manitowoc, WI (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 46 days.

(21) Appl. No.: 12/777,094

(22) Filed: May 10, 2010

(65) Prior Publication Data

US 2010/0294735 A1 Nov. 25, 2010

Related U.S. Application Data

(60) Provisional application No. 61/179,983, filed on May 20, 2009.

(51) Int. Cl.
*B66C 23/68* (2006.01)

(52) U.S. Cl. ..... 212/299; 212/231; 212/348

(58) Field of Classification Search ..... 212/299, 212/231, 182
See application file for complete search history.

(56) References Cited

U.S. PATENT DOCUMENTS

| | | | | |
|---|---|---|---|---|
| 4,383,616 | A | 5/1983 | Sterner et al. | |
| 6,550,624 | B1 * | 4/2003 | Irsh et al. | 212/299 |
| 7,341,158 | B2 | 3/2008 | Toudou et al. | |
| 7,455,187 | B2 | 11/2008 | Toudou et al. | |
| 2002/0070187 | A1 | 6/2002 | Willim | |

FOREIGN PATENT DOCUMENTS

| | | | |
|---|---|---|---|
| DE | 200 02 748 | U1 | 8/2000 |
| DE | 20 2005 005 627 | U1 | 9/2006 |
| DE | 20 2008 006 167 | U1 | 8/2008 |
| WO | WO 2005/054109 | A1 | 6/2005 |

OTHER PUBLICATIONS

Manitowoc 4100 W crane drawing (redacted) (1 pg) Jul. 19, 1967.

* cited by examiner

*Primary Examiner* — Emmanu M Marcelo
(74) *Attorney, Agent, or Firm* — Brinks Hofer Gilson & Lione; Steven P. Shurtz

(57) ABSTRACT

A backstay spreader attachable between a pair of backstay sections on a crane includes first and second members each having a backstay section connector at a first end and a pivoting joint connector at a second end, the pivoting joint connectors being used to hold the first and second members together with a pivotal connection and each having an extending portion extending away from the pivotal connection, with an angle between the extending portions. The backstay spreader also includes an actuator mounted between the pivoting joint connectors. The actuator controls the angle between the extending portions of the two pivoting joint connectors, which defines an angle between the first and second members. When the actuator forces the two extending portions towards each other, the first and second members pivot around the pivotal connection to force the first and second backstay sections further apart from one another, and when the actuator allows the two extending portions to pivot away from each other, the first and second members pivot towards each other, allowing the backstay sections to come closer together.

23 Claims, 5 Drawing Sheets

CRANE BACKSTAY SPREADER

REFERENCE TO EARLIER FILED APPLICATION

The present application claims the benefit of the filing date under 35 U.S.C. §119(e) of Provisional U.S. patent application Ser. No. 61/179,983, filed May 20, 2009; which is hereby incorporated by reference in its entirety.

BACKGROUND

The present invention relates to a backstay spreader used on a crane, such as mobile lifting crane, and particularly a backstay spreader that can have its length adjusted after being interconnected between a pair of backstay straps.

Lift cranes typically include a carbody; ground engaging members elevating the carbody off the ground; a rotating bed rotatably connected to the carbody such that the rotating bed can swing with respect to the ground engaging members; and a boom pivotally mounted on the rotating bed, with a load hoist line extending there from. For mobile lift cranes, there are different types of moveable ground engaging members, most notably tires for truck mounted cranes, and crawlers. Typically mobile lift cranes include a counterweight to help balance the crane when the crane lifts a load.

Since the crane will be used in various locations, it needs to be designed so that it can be transported from one job site to the next. This usually requires that the crane be dismantled into components that are of a size and weight that they can be transported by truck within highway transportation limits. The ease with which the crane can be dismantled and set up has an impact on the total cost of using the crane. Thus, to the extent that fewer man-hours are needed to set up the crane, there is a direct advantage to the crane owner or renter.

When the crane needs to work on particularly high buildings or structures, or in restricted spaces, a jib may be mounted at the top of the boom to provide required reach. This could be a fixed jib or a luffing jib. When a jib is employed, one or more jib struts are connected to the top of the boom or bottom of the jib. These struts support the jib rigging and provide a moment arm about which force can be applied to support a load being lifted by the jib. When a luffing jib is used, frequently two struts will be used, and the angle between the struts will be controlled by jib hoist rigging. Changing the angle between the two struts will thus change the angle between the boom and the luffing jib.

When a jib is used on a crane, jib backstay straps are connected between the jib strut and the rotating bed, typically by being connected to the boom butt, which of course is pivotally connected to the rotating bed. These straps are made of several separate sections. The boom also has straps (which could be referred to as backstay straps) associated with it, which connect between the top of the boom and either an equalizer suspended between the boom and a fixed mast, or between the boom and the top of a live mast. On a typical crane with a fixed mast, the boom hoist rigging comprises multiple parts of line that run between the equalizer and the top of the mast, and is used to control the angle of the boom.

The jib backstay straps and the boom hoist rigging potentially interfere with one another, since the boom hoist rigging and boom straps go between the top of the mast and the top of the boom, and the jib backstay straps go between the bottom of the boom and the strut supporting the jib, which extends backward from the top of the boom. If the boom and boom hoist rigging are very large, the jib backstay straps need to be spread apart to give room so that the jib backstay straps do not come into contact with the parts of line of the boom hoist rigging or the boom straps. The need for spreading of the jib backstay straps is even greater considering that not only does contact need to be avoided when the boom and jib are static, but when there is a load on the hook and the boom swings, bending and twisting moments in the boom and jib strut can cause deflection in the rigging that would cause contact if the jib backstay straps were not spread far enough apart.

It is convenient to transport the sections of the boom straps and jib backstay straps with the sections of boom between one job site and the next. This is because, for the most part, the number of sections and the length of each section of the boom straps and the jib backstay straps that will be needed are dependent on the number and lengths of the sections that are used to construct the boom. For example, a 100 foot boom may be made from a 10 foot boom butt, a 10 foot boom top and four 20 foot boom inserts. However, if the boom is going to be 120 feet long, five 20 foot boom inserts will be used. If the boom is going to be 130 feet long, five 20 foot inserts and one 10 foot insert will be used. For each of these different boom configurations, different numbers and lengths of sections of the boom straps and jib backstay straps will be used. However, it is convenient if the straps are transported between job sites on the tops of the boom sections where they can be easily connected together to make up the boom straps and jib backstay straps when the sections of boom are put together.

One problem that is encountered when a high-capacity crane is transported is that the width of the boom sections is limited by highway transportation limits. However, when the crane is set up, the equalizer may be so wide that the jib backstay straps will need to be further apart during use than the width at the points where the backstay straps are connected to the boom butt and strut top. In that case a spreader may be needed to spread the jib backstay straps apart once the crane is set up. While the sections of the jib backstay straps can still be transported on the top of the boom sections, they will need to be wider apart during use in the area of the boom hoist rigging than in their transport position.

One problem in providing a spreader between the jib backstay straps is that the spreader needs to be in place during operation, but where it needs to be placed is very high off the ground when the boom, mast, luffing jib and struts are in their operational position. Putting a spreader in place before the jib backstay straps are raised into place is not possible if the strap sections are sitting in brackets on the top of the boom sections on which they were transported. Thus there is a need for a way to spread the jib backstay straps apart after they have been raised up to the point that they are no longer in the brackets on the top of the boom sections. However, once they are raised up it is very difficult to position a worker at the elevation where the spreader needs to go and have that worker be able to insert a spreader between the jib backstay straps and spread the straps apart.

BRIEF SUMMARY

A backstay spreader has been invented that can have its length adjusted after being interconnected between a pair of backstay straps. In this way the spreader can be attached between the backstay straps when they are close to ground level but still held in brackets on the top of the boom sections, then the backstay straps can be raised up as the jib structure is assembled, and once the backstay sections are out of their brackets, the spreader can be extended to spread the straps to the distance apart that is needed for crane operation.

In a first aspect, the invention is a backstay spreader attached between a pair of backstay sections comprising first and second backstay sections each configured for use in constructing one of a pair of backstay straps on a crane; and a spreader connected between the first and second backstay sections, the spreader comprising: i) first and second members each having a backstay section connector at a first end and a pivoting joint connector at a second end, the pivoting joint connectors being used to hold the first and second members together with a pivotal connection and each having an extending portion extending away from the pivotal connection, with an angle between the extending portions, and the backstay connector on the first end of the first member connecting the first member to the first backstay section and the backstay connector on the first end of the second member connecting the second member to the second backstay section; and ii) an actuator mounted between the pivoting joint connectors; iii) wherein the actuator controls the angle between the extending portions of the two pivoting joint connectors, that angle also defining an angle between the first and second members. When the actuator forces the two extending portions towards each other, the first and second members pivot around the pivotal connection to force the first and second backstay sections further apart from one another, and when the actuator allows the two extending portions to pivot away from each other, the first and second members pivot towards each other, allowing the backstay sections to come closer together.

In a second aspect, the invention is a lift crane comprising a carbody; ground engaging members elevating the carbody off the ground; a rotating bed rotatably connected to the carbody; a boom pivotally mounted on the rotating bed; a jib attached adjacent the top of the boom; at least one strut having first and second ends connected at its first end adjacent the connection of the jib to the boom and at its second end supporting jib rigging, the jib rigging including a pair of backstay straps connected between the strut and the rotating bed; and an adjustable length spreader connected between the pair of backstay straps, the spreader including an actuator actuatable to spread the backstay straps apart at the place of connection of the spreader further than the backstay straps would be spread without the spreader.

In a third aspect, the invention is a method of setting up a lift crane wherein the lift crane comprises, during operation, a carbody; ground engaging members elevating the carbody off the ground; a rotating bed rotatably connected to the carbody; a boom pivotally mounted on the rotating bed; a jib attached adjacent the top of the boom; at least one strut also connected adjacent the top of the boom; and jib rigging connecting to the at least one strut and including a pair of backstay straps connected between the strut and the rotating bed; the method comprising: a) attaching the boom to the rotating bed and the strut to the boom; b) attaching the jib backstay straps between the strut and the rotating bed;

c) attaching an adjustable length spreader between the jib backstay straps, the spreader having a first length when being attached between the jib backstay straps; and d) extending the length of the spreader to a second length longer than the first length after the spreader is attached between the jib backstay straps.

The backstay spreader of the present invention may be attached between sections of the backstay straps while the backstay strap sections are in their transport position. As the main strut is lifted up, taking the jib backstay straps with it, the spreader is also raised up. Once the straps are clear of the brackets in which they were transported, the spreader can be activated. After the actuator spreads the jib backstay straps apart, the spreader preferably includes a locking feature that holds the spreader in its extended position during normal crane operation. Thus the jib backstay straps can be spread far apart to avoid contact with the boom hoist rigging even when a load is on the hook and the crane swings. The spreader can be put in place closer to the ground than the position the spreader will be during crane operation. Further, even though a crane set-up worker will still need to be lifted up to connect hydraulic lines and activate the spreader, these tasks are relatively simple and can be performed along with other tasks that a worker normally does from an elevated position during crane set-up. These and other advantages of the invention, as well as the invention itself, will be more easily understood in view of the attached drawings.

DETAILED DESCRIPTION OF THE DRAWINGS AND THE PRESENTLY PREFERRED EMBODIMENTS

Figure 1:
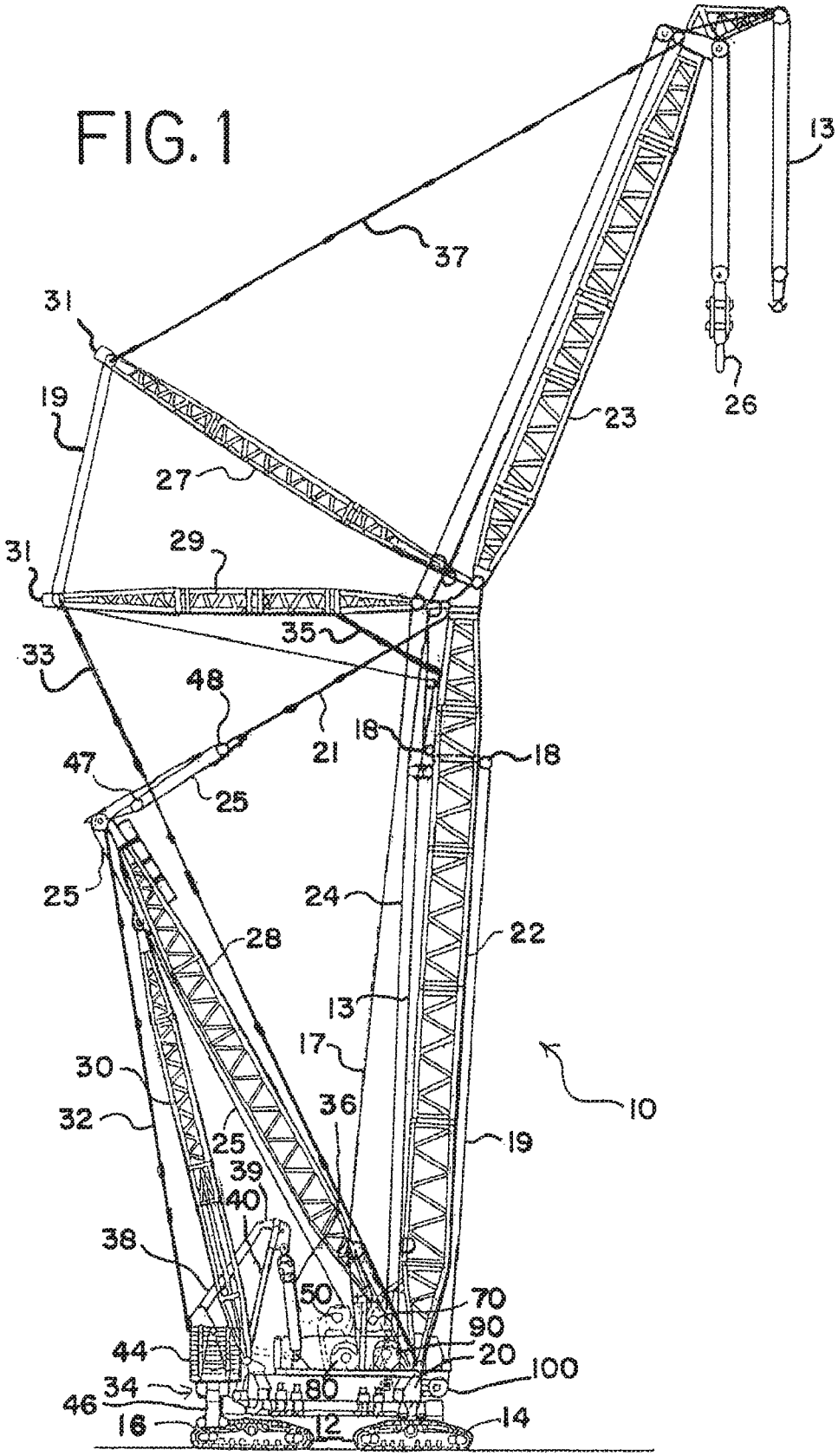
FIG. 1 is a side elevational view of a mobile lift crane using the present invention.

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

The preferred embodiment of the present invention relates to a high capacity mobile lift crane, other aspects of which are disclosed in U.S. Pat. No. 7,546,928 and the following co-pending United States patent applications assigned to the assignee of the present application: "Mobile Lift Crane With Variable Position Counterweight," Ser. No. 12/023,902, filed Jan. 31, 2008; "Mast Raising Structure And Process For High-Capacity Mobile Lift Crane," Ser. No. 11/740,726, filed Apr. 26, 2007; "Connection System For Crane Boom Segments," Ser. No. 12/273,310, filed Nov. 18, 2008; "Drive Tumbler And Track Drive For Mobile Vehicles, Including Lift Cranes," Ser. No. 12/368,143, filed Feb. 9, 2009; "Track Connection System For Mobile Vehicles, Including Lift Cranes," Ser. No. 12/368,125, filed Feb. 9, 2009; "Track Tensioning System For Mobile Vehicles, Including Lift Cranes," Ser. No. 12/368,113, filed Feb. 9, 2009; "Boom Hoist Transportation System And Crane Using Same," Ser. No. 12/561,007, filed Sep. 16, 2009; Carbody Connection System And Crane Using Same," Ser. No. 12/561,103, filed Sep. 16, 2009; "Trunnion Transportation System And Crane Using Same," Ser. No. 12/561,058, filed Sep. 16, 2009; "Drum Frame System For Cranes," Ser. No. 12/561,094, filed Sep. 16, 2009; Swing Drive System For Cranes," Ser. No. 12/710,960, filed Feb. 23, 2010; "Crane Hook Block," Ser. No. 12/709,678, filed Feb. 22, 2010; "Counterweight Block And Assemblies For Cranes," Ser. No. 12/718,156, filed Mar. 5, 2010; "Folding Jib Main Strut And Transportable Reeved Strut Caps," Ser. No. 12/730,421, filed Mar. 24, 2010; and "Crane Boom Stop," Ser. No. 61/179,935, filed May 20, 2009. Each of these applications is hereby incorporated by reference.

The following term used in the specification and claims has a meaning defined as follows.

The term "actuator" refers to an inanimate device that causes a change in a structure to which it is linked by converting energy supplied to the actuator into a desired mechanical motion that modifies the linked structure. In preferred embodiments of the invention, the actuator produces a desired linear motion that either spreads apart of draws together portions of a connector that are pivotally attached to one another. Typically the energy will be provided from a non-human source. However, an individual, using mechanical advantage, could supply the energy to an actuator useable in the present invention.

While the invention will have applicability to many types of cranes, it will be described in connection with mobile lift crane 10, shown in an operational configuration in FIGS. 1-3. The mobile lift crane 10 includes lower works, also referred to as a carbody 12, and moveable ground engaging members in the form of crawlers 14 and 16. There are of course two front crawlers 14 and two rear crawlers 16. In the crane 10, the ground engaging members could be just one set of crawlers, one crawler on each side. Of course additional crawlers than those shown can be used, as well as other types of ground engaging members, such as tires.

The rotating bed 20 is mounted to the carbody 12 with a slewing ring, such that the rotating bed 20 can swing about an axis with respect to the ground engaging members 14, 16. The rotating bed supports a boom 22 pivotally mounted on a front portion of the rotating bed; a mast 28 mounted at its first end on the rotating bed, with a lower equalizer 47 connected to the mast adjacent the second end of the mast; a backhitch 30 connected between the mast and a rear portion of the rotating bed; and a moveable counterweight unit 34. The counterweight may be in the form of multiple stacks of individual counterweight members 44 on a support member.

Boom hoist rigging (described in more detail below) between the top of mast 28 and boom 22 is used to control the boom angle and transfer load so that the counterweight can be used to balance a load lifted by the crane. A load hoist line 24 is trained over a pulley on the boom 22, supporting a hook 26. At the other end, the load hoist line is wound on a first main load hoist drum 70 connected to the rotating bed, described in more detail below. The rotating bed 20 includes other elements commonly found on a mobile lift crane, such as an operator's cab, hoist drum 50 for the boom hoist rigging, a second main hoist drum 80 and an auxiliary load hoist drum 90 for a whip line, also described in more detail below.

Figure 2:
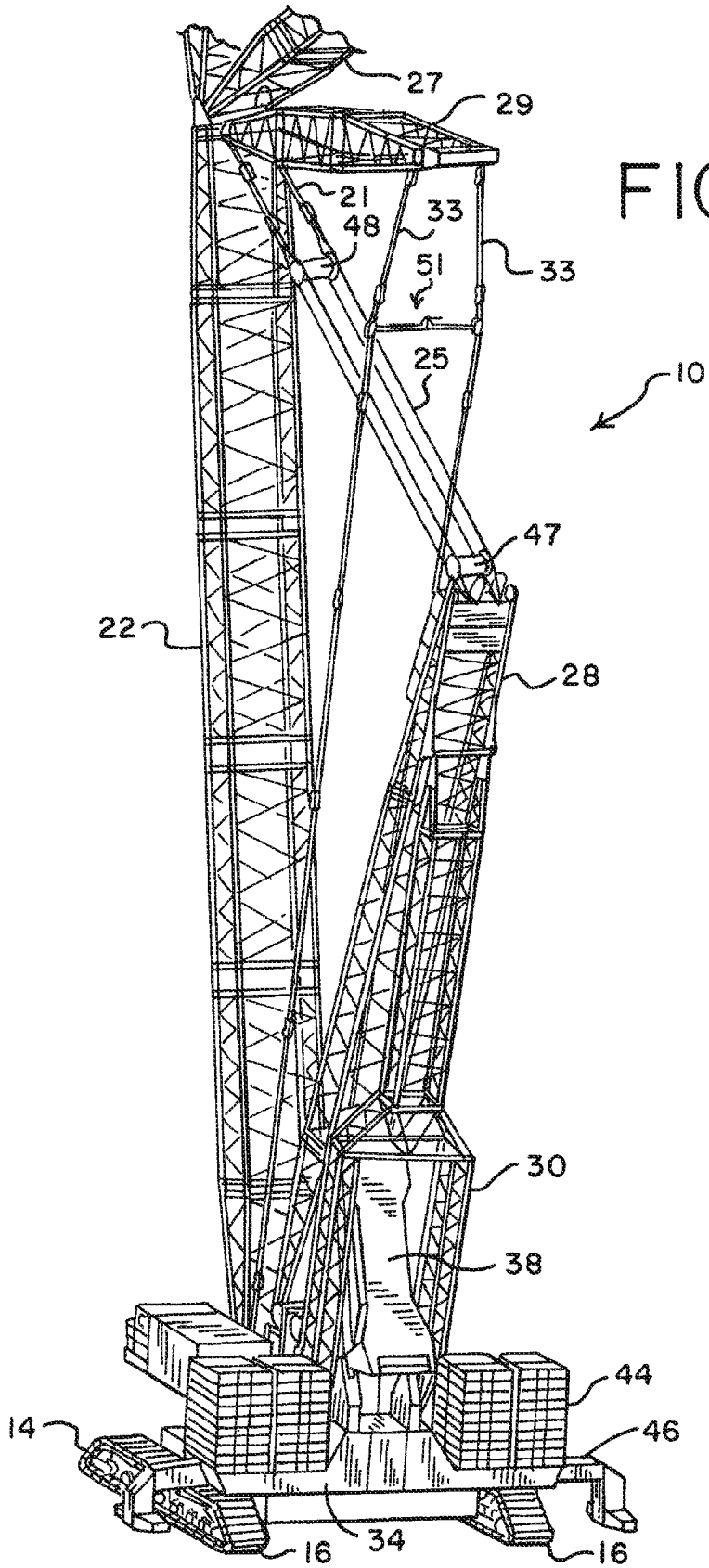
FIG. 2 is a rear perspective view of the crane of FIG. 1 with some components removed for sake of clarity but showing the backstay spreader of the present invention in use.

As shown in FIG. 1, the boom 22 includes a jib 23, preferably a luffing jib pivotally mounted to the top of the main boom 22. The crane also includes jib strut 27 and main strut 29, as well as associated luffing jib rigging and a luffing jib hoist drum 100. A luffing jib hoist line 19 runs from the drum 100, through one or more wire guides 18, and up to the rigging between sheaves in strut caps 31, and is used to control the angle between jib strut 27 and main strut 29. In one embodiment, the luffing jib hoist line 19 is a wire rope of about 34 mm in thickness. The jib hoist line 19 is reeved through sheaves of the first and second strut caps 31 each respectively attached to the jib strut 27 and main strut 29. The luffing jib hoist line 19 dead ends on either of the strut caps 31 or on one of the struts 27, 29.

Two jib backstay straps 33 are connected between the end of the main strut 29, e.g., to or near the cap thereof, and the bottom of the boom 22. Since the boom 22 is connected to the rotating bed 20, the jib backstay straps 33 are connected to the rotating bed 20 though being connected to the boom 22. These jib backstay straps are made of multiple fixed-length sections. Selection of the number of sections and the length of each section allows changing the length of the longest side of the fixed-angle triangle formed between the main strut 29 and the boom 22 to accommodate different boom lengths. By changing the length of the jib backstay straps 33, a constant angle may be maintained between the main strut 29 and the boom 22 for each length of the boom for which the crane is designed. As discussed in more detail below, an adjustable length spreader is connected between the pair of jib backstay straps 33, the spreader preferably including a hydraulic cylinder actuatable to spread the jib backstay straps apart at the place of connection of the spreader further than the jib backstay straps would be spread without the spreader.

Sections of jib support straps 37 may be connected between the end of the jib strut 27 and adjacent the top of the luffing jib 23 to maintain a constant angle there between. Thus, the angle between the main strut 29 and jib strut 27 also defines the angle that the luffing jib 23 makes with the main boom 22. By using the jib support straps 37 as described, panning out or retracting the luffing jib hoist line 19 allows expanding or retracting the angle between the main and jib struts 27, 29. A strut stop 35 is connected between the main strut 29 and the boom 22 to provide support to the main strut 29 if no load is on the jib and the forces pulling the main strut up are less than the forces pulling the main strut down. Details of how the struts, jib hoist rigging and jib backstay straps 33 are assembled are more fully disclosed in U.S. patent application Ser. No. 12/730,421.

The backhitch 30 is connected adjacent the top of the mast 28, but down the mast far enough that it does not interfere with other items connected to the mast. The backhitch 30 may comprise a lattice member, as shown in FIG. 1, designed to carry both compression and tension loads. In the crane 10, the mast is held at a fixed angle with respect to the rotating bed during crane operations, such as a pick, move and set operation.

The counterweight unit 34 is moveable with respect to the rest of the rotating bed 20. A tension member 32 connected adjacent the top of the mast supports the counterweight unit in a suspended mode. A counterweight movement structure is connected between the rotating bed and the counterweight unit such that the counterweight unit may be moved to and held at a first position in front of the top of the mast, and moved to and held at a second position rearward of the top of the mast, described more fully in U.S. patent application Ser. No. 12/023,902.

At least one linear actuation device 36, such as a hydraulic cylinder, or alternatively a rack and pinion assembly, and at least one arm pivotally connected at a first end to the rotating bed and at a second end to the a linear actuation device 36, are used in the counterweight movement structure of crane 10 to change the position of the counterweight. The arm and linear actuation device 36 are connected between the rotating bed and the counterweight unit such that extension and retraction of the linear actuation device 36 changes the position of the counterweight unit compared to the rotating bed. While FIGS. 1-3 show the counterweight unit in its most forward position, the linear actuation device 36 can be partially or fully extended, which moves the counterweight unit to mid and aft positions, or any intermediate position, such as when a load is suspended from the hook 26.

In the preferred embodiment of the counterweight movement structure, a pivot frame 40 (FIG. 3), which may be a solid welded plate structure as shown, is connected between the rotating bed 20 and the second end of the linear actuation device 36. The rear arm 38 is connected between the pivot frame 40 and the counterweight unit. The rear arm 38 is also a welded plate structure with an angled portion 39 at the end that connects to the pivot frame 40. This allows the arm 38 to connect directly in line with the pivot frame 40. As best seen in FIG. 2, the backhitch 30 has an A-shape configuration, with spread-apart lower legs, which allows the counterweight movement structure to pass between the legs when needed.

The crane 10 may be equipped with a counterweight support system 46, which may be required to comply with crane regulations in some countries. The counterweight movement structure and counterweight support structure are more fully disclosed in U.S. patent application Ser. No. 12/023,902.

The boom hoist rigging includes a boom hoist line in the form of wire rope 25 wound on a boom hoist drum 50, and reeved through sheaves on a lower equalizer 47 and an upper equalizer 48. The boom hoist drum is mounted in a frame 60 (FIG. 3) connected to the rotating bed. The rigging also includes fixed length pendants 21 connected between the boom top and the upper equalizer 48. The lower equalizer 47 is connected to the rotating bed 20 though the mast 28. This arrangement allows rotation of the boom hoist drum 50 to change the amount of boom hoist line 25 between the lower equalizer 47 and the upper equalizer 48, thereby changing the angle between the rotating bed 20 and the boom 22.

The boom hoist drum frame 60, the lower equalizer 47 and the upper equalizer 48 each include cooperating attachment structures whereby the lower and upper equalizers can be detachably connected to the boom hoist drum frame so that the boom hoist drum, the lower equalizer, the upper equalizer and the boom hoist line can be transported as a combined assembly. The combined boom hoist drum 50, frame 60, lower equalizer 47 and upper equalizer 48, arranged as they would be for transportation between job sites, are described in U.S. patent application Ser. No. 12/561,007.

Crane 10 includes four drums each mounted in a frame and connected to the rotating bed in a stacked configuration. (The rotating bed includes a main frame and front and rear roller carriers.) In addition, the jib hoist drum 100 is mounted in a frame attached to the front surface of the front roller carrier. Frames of two of the four stacked drums are connected directly to the rotating bed, while the frames of the other two drums are indirectly connected to the rotating bed by being directly connected to at least one of the two drum frames connected directly to the rotating bed. In this case, the four stacked drums are preferably the first main load hoist drum 70 with load hoist line 24 wound thereon, the second main load hoist drum 80 with load hoist line 17 wound thereon, the auxiliary load hoist drum 90 with whip line 13 wound thereon, and the boom hoist drum 50 with boom hoist line 25 wound thereon. Preferably, the frame 91 of the auxiliary load hoist drum 90 and frame 81 of the second main load hoist drum 80 are connected directly to the rotating bed (the frame 91 pins at its front onto the front roller carrier), the frame 71 of the first main load hoist drum 70 is connected to both of frames 81 and 91, while the frame 60 for the boom hoist drum 50 is connected to frame 81. In that regard, the boom hoist drum frame 60 is thus stacked on top of and pinned directly to the second main load hoist drum frame 81, and the first main load hoist drum frame 71 is stacked on top of and pinned directly to the auxiliary load hoist drum frame 91. The drum frames are connected to the rotating bed and to each other by removable pins, allowing the frames to be disconnected from and transported separately from the rotating bed.

A sixth drum includes a rigging winch drum 110 on which is wound a rigging winch line 111. The rigging winch drum 110 is attached to a lower section of the rotating bed 20 and is lighter weight than the other drums. The rigging winch line 111, in one embodiment, may be a 19 mm winch line that is generally used to help assemble the crane 10, such as being used to help to speed reeving the sheaves of the strut caps 31, and assembly of the main strut 29 as discussed in U.S. patent application Ser. No. 12/730,421.

Figure 3:
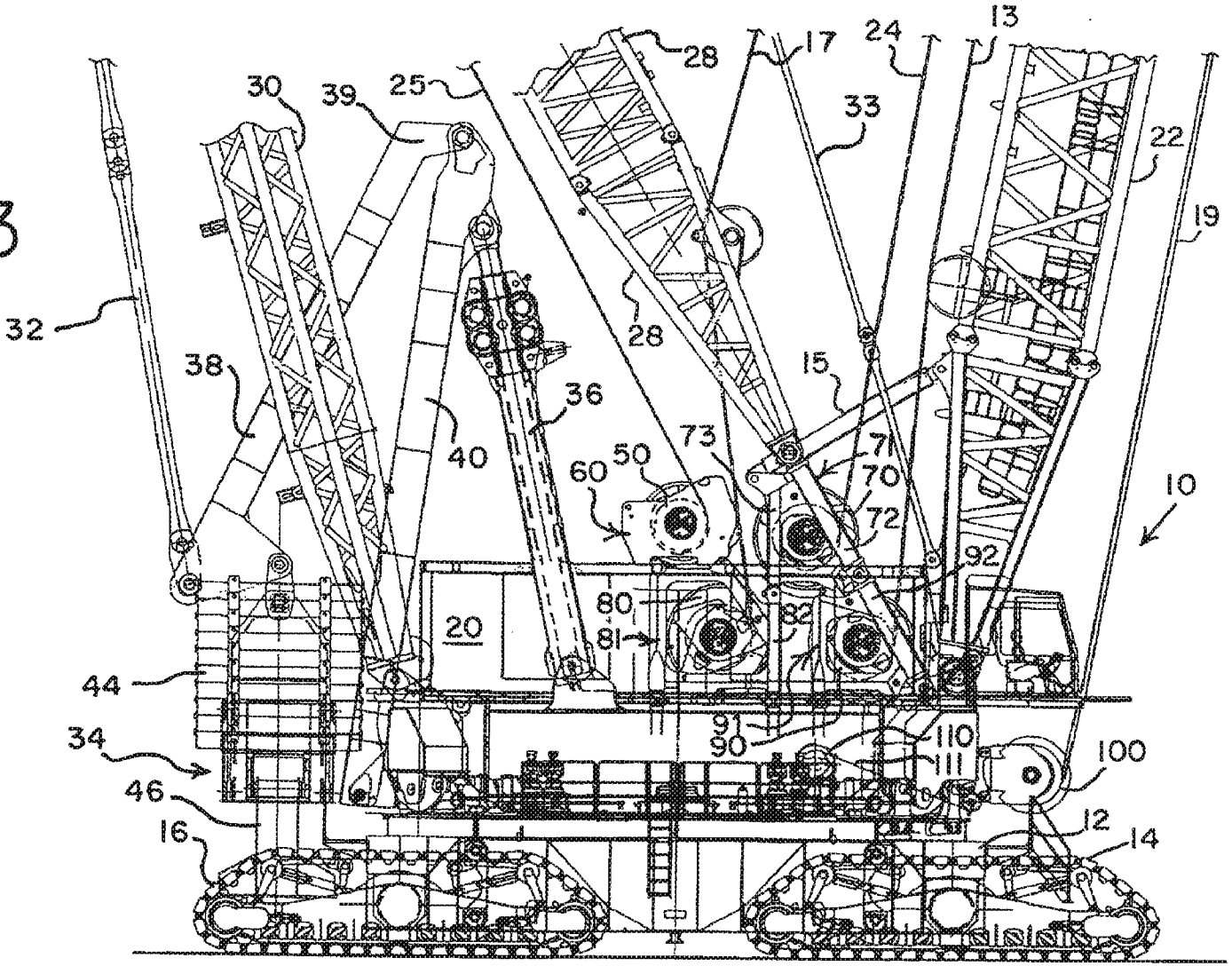
FIG. 3 is an enlarged partial side elevational view of e mobile lift of FIG. 1.

As shown in FIG. 3, the stack of drum frames allows for placement of the mast 28 and a boom stop 15 to be connected indirectly to the rotating bed such that forces directed along a line of action of the mast 28 and the boom stop 15 are transferred to the rotating bed through the legs 72 and 92 of drum frames 71 and 91. The boom stop 15 has a line of action through the longitudinal axis of the boom stop. The forces in the boom stop are thus transferred from the boom stop into a pin at the top of leg 73 that is in line with the longitudinal axis of the boom stop. The forces at the pin are then transferred to the rotating bed through the geometry of the members of drum frames 71, 81 and 91. If the boom 22 were to recoil backward beyond its maximum designed nearly-vertical position, compressive loads would be transmitted through the boom stop 15 to the pin at the top of leg 73 into the structure of frame 71. That load would be resolved by a compressive force down the legs 73 of frame 71 and legs 82 of frame 81, and a tension load through the legs 72 of frame 71 and legs 92 of frame 91.

Figure 4:
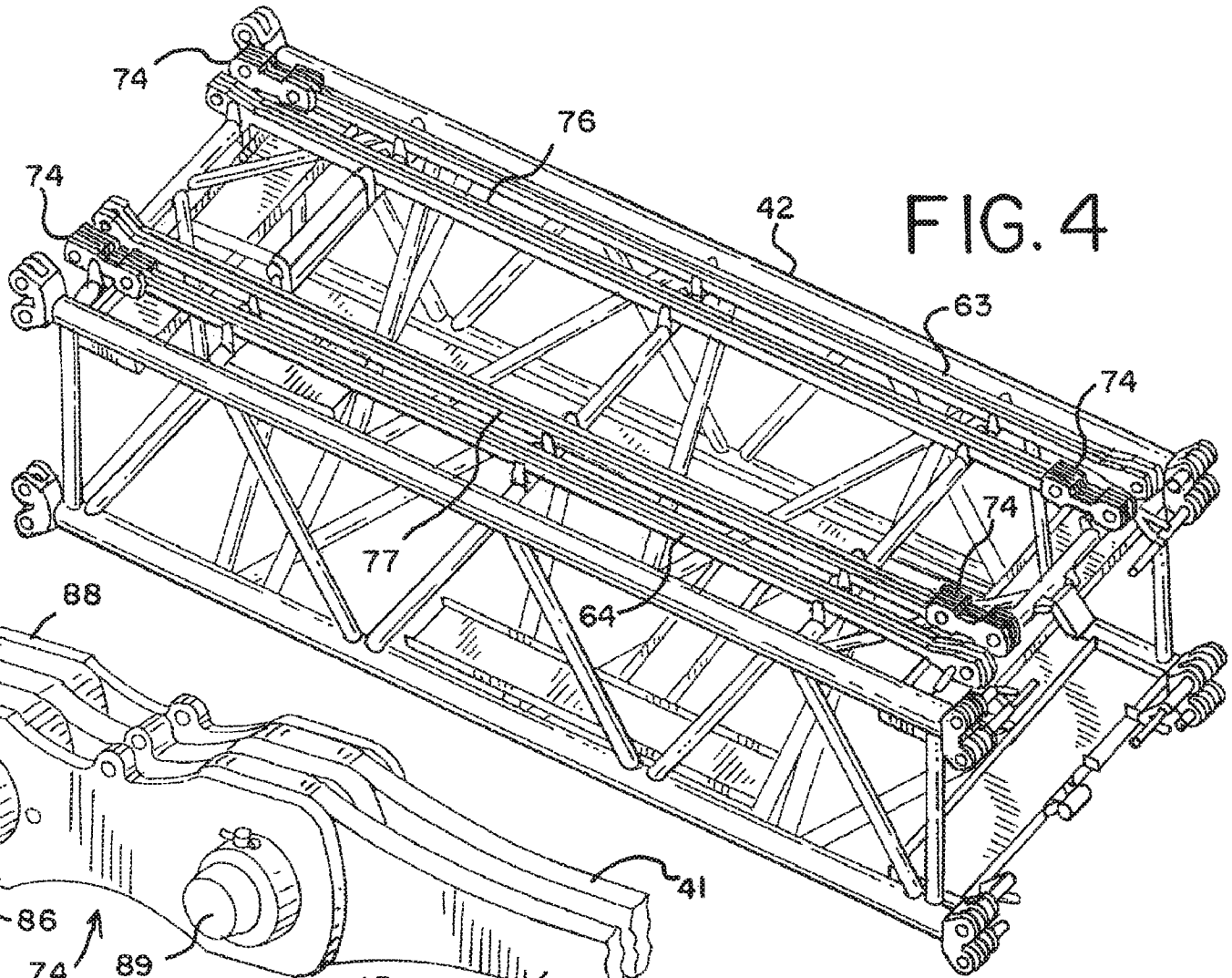
FIG. 4 is a perspective view of a boom section used to construct the crane of FIG. 1, with sections of boom straps and jib backstay straps attached, in a transport mode.

As discussed above, the boom 22 is made by connecting multiple boom sections together, the jib backstay straps 33 are each made by connecting multiple backstay strap sections together, and the boom is supported during crane operation by a pair of boom straps 21 each made from sections. As best shown in FIG. 4, two jib backstay strap sections 63, 64 are transported to a job site prior to crane setup while mounted in a parallel fashion on a boom section 42 with a width between them. Two boom strap sections 76, 77 are also transported mounted in a parallel fashion on the boom section 42 with a width between them, the boom strap sections 76, 77 being mounted on the boom section 42 in between the jib backstay strap sections 63, 64. Preferably the boom strap sections 76 and 77 are transported at a width that corresponds to the width they will be at when attached between the top of the boom 22 and the second equalizer 48, and the jib backstay strap sections 63 and 64 are transported at a width that corresponds to the width they will be at when attached at the boom butt and to the end of the main strut 29.

Figure 5:
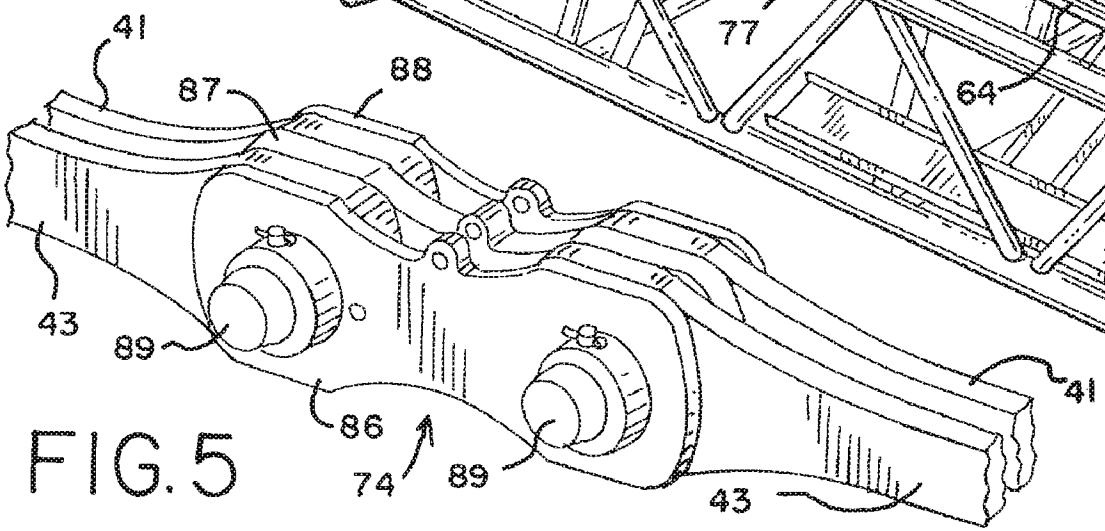
FIG. 5 is a detailed view of the longitudinal connection between two sections of jib backstay straps used in the crane of FIG. 1.

Preferably each of the jib backstay strap sections 63 and 64 comprise double bars, and the backstay strap sections include connectors 74 on one end when being transported that will allow them to be connected to another jib backstay strap section. FIG. 5 shows a preferred connection made between sections of jib backstay straps. As noted, each section is made of double bars 41 and 43. These bars comprise a widened portion on their ends, with a hole through the widened portion. The connector 74 includes three links 86, 87 and 88, each having widened portions at both ends with a hole through each of the widened ends. Link 87 is placed between bars 41 and 43, and links 86 and 88 are placed on the outsides of bars 41 and 43, sandwiching the ends of the bars 41 and 43 and the link 87 between them. Pins 89 are secured through the holes in the bars and links to allow the links to hold the end of one section of the backstay strap to another section of the backstay strap.

When the jib backstay sections 63, 64 are transported on top the boom section 42, the connector 74 is attached to one end of the jib backstay section with one pin 89, as shown in FIG. 4, and the second pin 89 is removed. To shorten the length of the combined strap section and connector 74, the links 86, 87 and 88 are folded back 180°. The center link 87 fits between the bars 41 and 43, and the outer links 86 and 88 lay alongside the bars 41 and 43. When two backstay sections are to be coupled together during crane set-up, the links 86, 87 and 88 are folded back out to their extended position, the bars 41 and 43 from the second section are placed in between the links 86, 87 and 88 with their holes lined up so that the second pin 89 can be inserted and secured.

When setting up the crane 10, first the boom 22 is attached to the rotating bed 20 and the main strut 29 is attached to the boom top. The end sections of jib backstay straps 33 are attached to the main strut 29 and the bottom of boom 22, and additional sections are connected to one another. However, the final connection between the sections making up each jib backstay strap 33 is made as the main strut 29 is raised into position, as described in U.S. patent application Ser. No. 12/730,421.

An adjustable length spreader 51 (FIG. 6) is attached between the jib backstay straps 33 as the sections of the straps are connected to one another. The preferred spreader 51 connects to the jib backstay strap sections at a joint between two jib backstay strap sections. Also, the spreader is preferably connected between sections of the jib backstay straps prior to the jib backstay straps 33 being fully connected between the strut 29 and the bottom of boom 22.

Figure 6:
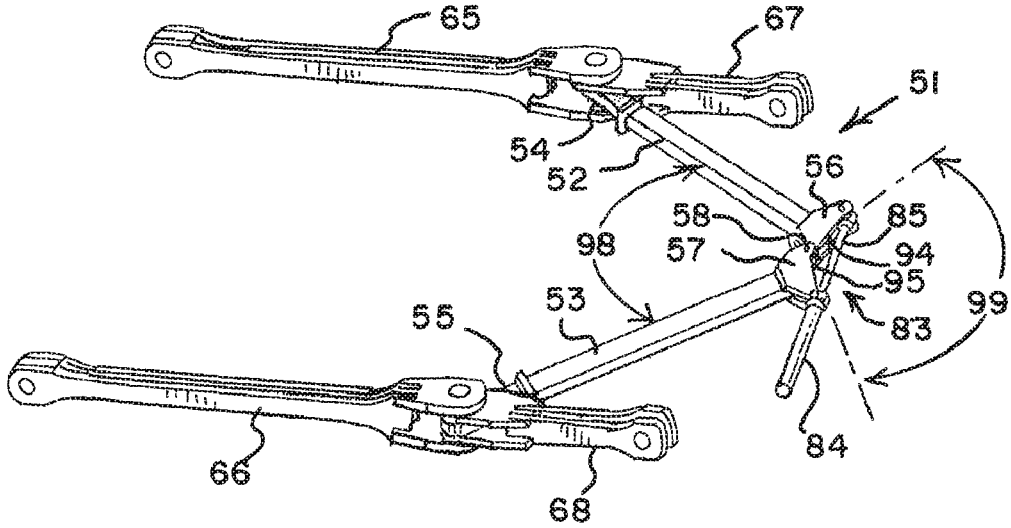
FIG. 6 is a perspective view of a backstay spreader connected between sections of jib backstay straps used to construct the crane of FIG. 1, in a transport configuration.

The spreader 51 is transported in the form shown in FIG. 6, already connected between short sections 65, 66, 67, 68 of the jib backstay straps 33 while the sections 65, 66, 67, 68 are spread apart at their transport width. These short sections have free ends that can be connected to other sections of the backstay straps using connectors 74. However, the short sections 65 and 66 are attached respectively to short sections 67 and 68 with a differ type of connection, one that allows the spreader 51 to tie into the connection between the sections 65, 66, 67 and 68. The short sections each have two flattened portions, with a hole through the flattened portions sized to receive a pin used to hold sections of the backstay straps 33 together, as well as to connect with the spreader 51. When being attached between the backstay straps, the spreader has a first length. Thereafter the length of the spreader is extended to a second length (FIG. 7) longer than the first length.

The backstay spreader includes first and second members 52, 53 each having a backstay section connector 54, 55 at a first end and a pivoting joint connector 56, 57 at a second end. The backstay connector 54 on the first end of the first member 52 connects the first member 52 to the first backstay section 65. The backstay connector 55 on the first end of the second member 53 connects the second member to the second backstay section 66. Each backstay section connector 54, 55 comprises a flattened portion at the first end of the respective first and second members 52, 53, with a hole through the flattened portion sized to receive the pin used to hold the sections 65, 67 and 66, 68 together.

The pivoting joint connectors 56, 57 are used to hold the first and second members together with a pivotal connection 58. Each pivoting joint connector has a portion extending away from the pivotal connection, with an angle 99 between the extending portions. An actuator 83 is mounted between the pivoting joint connectors 56, 57, The actuator 83 controls the angle 99 between the extending portions of the two pivoting joint connectors. That angle also defines an angle 98 between the first and second members 52, 53, When the actuator 83 forces the two extending portions towards each other, the first and second members 52, 53 pivot around the pivotal connection 58 to force the first and second backstay sections 65, 66 further apart from one another. When the actuator 83 allows the two extending portions to pivot away from each other, the first and second members 52, 53 pivot towards each other, allowing the backstay sections 65, 66 to come closer together.

The first and second members 52, 53 of the spreader 51 preferably each comprise straight legs, and the legs are brought into direct opposing alignment with each other such that the first and second members are at an angle 98 of 180° from each other when the actuator 83 forces the extending portions into contact with each other.

The extending portions each preferably comprise machined bearing faces 94, 95 that carry a compressive load when the actuator 83 forces the extending portions together, thereby forcing the backstay sections 65, 66 apart from one another.

The actuator 83 is preferably a hydraulic cylinder. The hydraulic cylinder has a cylinder body 84 and a rod 85 extendable from the body 84. The body 84 is attached to the extending portion of the pivoting joint connector 57 of the second member 53, and the rod 85 is connected to the extending portion of the pivoting joint connector 56 of the first member 52. Of course the body 84 and rod 85 could be connected in an opposite manner, so that the body 84 was connected to the extending portion of the pivoting joint connector 56 of the first member 52.

Preferably the spreader 51 will include some feature to "lock" the spreader in a spread-apart position. For example, if a hydraulic cylinder 83 is used, it would be best if hydraulic lines and hydraulic pressure did not have to stay connected to the hydraulic cylinder during crane operation. A mechanical lock configured to lock the spreader in a spread-apart position could be included. Alternatively, and preferably, instead of having a mechanical lock, the spreader will stay open because of the geometry of the parts, i.e., the design of the backstay spreader members is such that they naturally wants to stay in a spread-apart position. One way to accomplish this is to design the parts so that to get from the fully spread-apart position back to a less spread-apart position, the spreader would have to initially get longer than at is fully spread position because of the shape of the pivoting joint connectors and placement of the pivotal connection.

Figure 7:
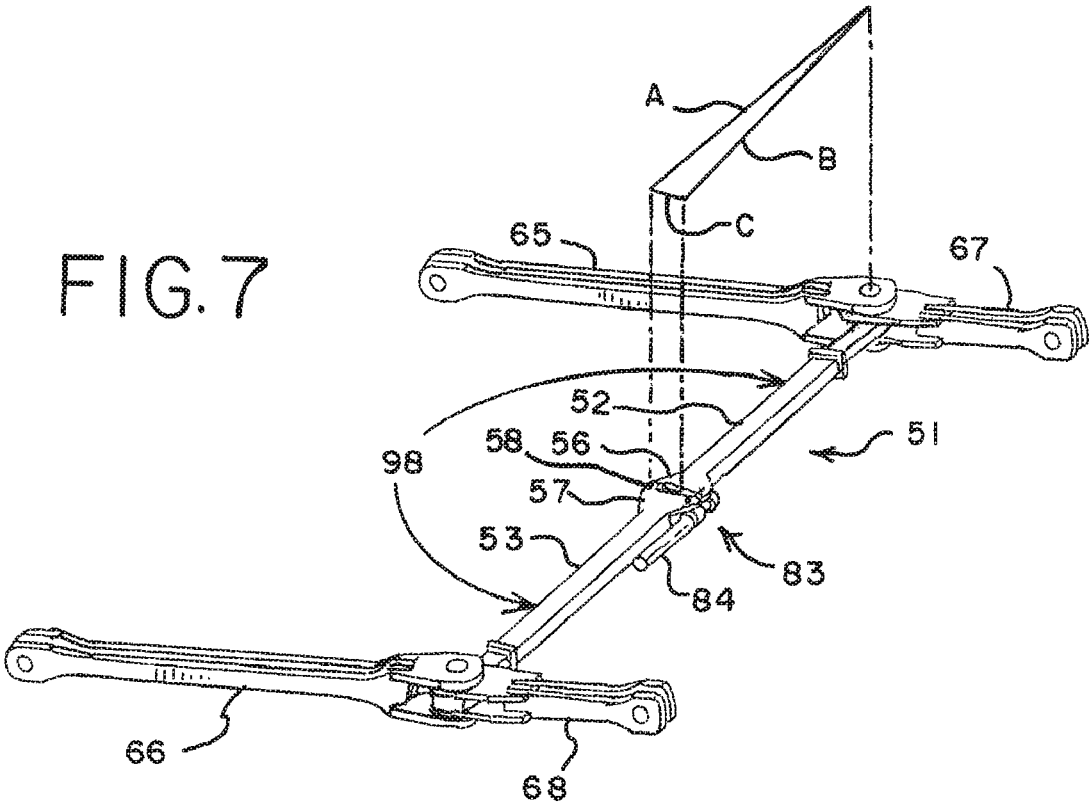
FIG. 7 is a perspective view of the backstay spreader connected between sections of jib backstay straps of FIG. 6 in an operational configuration.

Considering FIG. 7, the distance A between the axis of connection at the backstay strap to the axis of the pivotal connection 58 is slightly longer than the distance B from the axis of connection at the backstay section to the bearing surface. This occurs because the pivotal connection 85 is offset from the center line through the extended parts by a distance C. Since the lines containing distances B and C intersect at a right angle, $A^2B^2+C^2$, and A is therefore greater than B. To get the first and second members from the extended position of FIG. 7 back to the partially folded position of FIG. 6, the backstay spreader 51 has to push the backstay straps further apart (from a width of 2B to a width of 2A). Since greater compressive force is applied by the backstay straps to the spreader members 52 and 53 the wider the backstay straps are spread apart, the increase in compressive force will naturally urge the spreader to stay in the position of FIG. 7. Of course the hydraulic cylinder 83 can be activated to overcome this force and push the extended portions apart.

It should be understood that various changes and modifications to the presently preferred embodiments described herein will be apparent to those skilled in the art. Instead of the adjustable length spreader 51 depicted, a crane could use a different type of adjustable length spreader that includes an actuator. And even where the adjustable length spreader is built with members like those shown in FIGS. 6 and 7, instead of using a hydraulic cylinder as the actuator 83, a screw mechanism could be used to spread apart and draw together the extending portions of the pivoting joint connectors 56 and 57. Instead of having straight legs, first and second members 52 and 53 could be shaped differently. While the preferred spreader is shown used in spreading luffing jib backstay straps, the spreader of the present invention can be used to spread fixed jib backstay straps and other backstay straps on a crane, such as boom straps. Such changes and modifications can be made without departing from the spirit and scope of the present invention and without diminishing its intended advantages. It is therefore intended that such changes and modifications be covered by the appended claims.

The invention claimed is:

1. A backstay spreader attached between a pair of backstay sections comprising:

a) first and second backstay sections each configured for use in constructing one of a pair of backstay straps on a crane; and b) a spreader connected between the first and second backstay sections, the spreader comprising:

i) first and second members each having a backstay section connector at a first end and a pivoting joint connector at a second end, the pivoting joint connectors being used to hold the first and second members together with a pivotal connection and each having an extending portion extending away from the pivotal connection, with an angle between the extending portions, and the backstay connector on the first end of the first member connecting the first member to the first backstay section and the backstay connector on the first end of the second member connecting the second member to the second backstay section; and ii) an actuator mounted between the pivoting joint connectors;

iii) wherein the actuator controls the angle between the extending portions of the two pivoting joint connectors, that angle also defining an angle between the first and second members;

c) whereby when the actuator forces the two extending portions towards each other, the first and second members pivot around the pivotal connection to force the first and second backstay sections further apart from one another, and when the actuator allows the two extending portions to pivot away from each other, the first and second members pivot towards each other, allowing the backstay sections to come closer together.

2. The combination of claim 1 wherein each of the first and second members of the spreader connects to its respective backstay section at a joint between two backstay sections.

3. The combination of claim 1 wherein the first and second members of the spreader each comprise straight legs, and the legs are brought into direct opposing alignment with each other such that the first and second members are at an angle of 180° from each other when the actuator forces the extending portions into contact with each other.

4. The combination of claim 1 wherein the extending portions each comprise machined bearing faces that carry a compressive load when the actuator forces the extending portions together, thereby forcing the backstay sections apart from one another.

5. The combination of claim 1 wherein the actuator comprises a hydraulic cylinder.

6. The combination of claim 1 wherein the backstay sections each comprise double bars.

7. The combination of claim 1 further comprising a locking feature configured to lock the spreader in a spread-apart position.

8. The combination of claim 7 wherein the locking feature is selected from the group consisting of a mechanical lock and a lock functional to keep the spreader open because of the geometry of the parts of the spreader.

9. The combination of claim 1 wherein the backstay spreader members naturally wants to stay in a spread-apart position because to get from the fully spread-apart position back to a less spread apart position, the spreader would have to initially get longer than at is fully spread position because of the shape of the pivoting joint connectors and placement of the pivotal connection.

10. The combination of claim 1 wherein the backstay section connectors comprise a flattened portion at the first end of each of the first and second members, with a hole through the flattened portion sized to receive a pin used to hold sections of the backstay together.

11. A lift crane comprising:

a) a carbody;

b) ground engaging members elevating the carbody off the ground;

c) a rotating bed rotatably connected to the carbody;

d) a boom pivotally mounted on the rotating bed;

e) a jib attached adjacent the top of the boom;

f) at least one strut having first and second ends connected at its first end adjacent the connection of the jib to the boom and at its second end supporting jib rigging, the jib rigging including a pair of jib backstay straps connected between the strut and the rotating bed; and g) an adjustable length spreader connected between the pair of jib backstay straps, the spreader not being connected between the jib backstay straps and the boom, the spreader including an actuator actuatable to spread the jib backstay straps apart at the place of connection of the spreader further than the jib backstay straps would be spread without the spreader.

12. The lift crane of claim 11 wherein the jib comprises a luffing jib pivotally attached to the boom, and the jib rigging can be used to change the angle of the luffing jib with respect to the boom.

13. The lift crane of claim 12 wherein the at least one strut comprises a main strut and a jib strut, and the rigging includes multiple parts of line running between sets of sheaves mounted on the main and jib struts, and the jib backstay straps are connected to the main strut.

14. The lift crane of claim 11 wherein the jib backstay straps are connected to the rotating bed through being connected to the boom.

15. The lift crane of claim 11 wherein the angle of the boom compared to the plane of rotation of the rotating bed is controlled by boom hoist rigging mounted between the top of a mast and the top of the boom, and the spreader spreads the jib backstay straps apart so that the jib backstay straps do not contact the boom hoist rigging during crane operation.

16. The lift crane of claim 11 wherein the actuator comprises a hydraulic cylinder.

17. The lift crane of claim 16 wherein the adjustable length spreader comprises:

a) first and second members each having a backstay connector at a first end and a pivoting joint connector at a second end, the pivoting joint connectors being used to hold the first and second members together with a pivotal connection and each having an extending portion extending away from the pivotal connection, with an angle between the extending portions, and the backstay connector on the first end of the first member connecting the first member to one of the jib backstay straps, and the backstay connector on the first end of the second member connecting the second member to the other of the jib backstay straps; and b) the hydraulic cylinder has a cylinder body and a rod extendable from the body, with the body attached to the extending portion of the first member and the rod connected to the extending portion of the second member;

c) wherein the hydraulic cylinder controls the angle between the extending portions of the two pivoting joint connectors, that angle also defining an angle between the first and second members.

18. A method of setting up a lift crane wherein the lift crane comprises, during operation, a carbody; ground engaging members elevating the carbody off the ground; a rotating bed rotatably connected to the carbody; a boom pivotally mounted on the rotating bed; a jib attached adjacent the top of the boom; at least one strut also connected adjacent the top of the boom; and jib rigging connecting to the at least one strut and including a pair of jib backstay straps connected between the strut and the rotating bed; the method comprising:

a) attaching the boom to the rotating bed and the strut to the boom;

b) attaching the jib backstay straps between the strut and the rotating bed;

c) attaching an adjustable length spreader between the jib backstay straps, the spreader having a first length when being attached between the jib backstay straps; and d) extending the length of the spreader to a second length longer than the first length after the spreader is attached between the jib backstay straps, the spreader not being connected between the jib backstay straps and the boom during crane operation.

19. The method of claim 18 wherein the boom is made by connecting multiple boom sections together, and the jib backstay straps are each made by connecting multiple jib backstay strap sections together, and two jib backstay sections are transported to a job site prior to crane setup while mounted in a parallel fashion on a boom section with a width between them, and the adjustable length spreader is connected between sections of the jib backstay while the sections are spaced apart at their transport width.

20. The method of claim 19 wherein the boom is supported during crane operation by a pair of boom straps each made from sections, and two boom strap sections are transported to a job site prior to crane setup while mounted in a parallel fashion on the boom section with a width between them, the boom strap sections being mounted on the boom section in between the jib backstay sections.

21. The method of claim 18 wherein the jib backstay straps are each made by connecting multiple jib backstay sections together and the spreader connects to the jib backstay sections at a joint between two jib backstay sections.

22. The method of claim 18 wherein the jib backstay straps are each made by connecting multiple jib backstay sections together and the spreader is connected between sections of the jib backstay straps prior to the jib backstay straps being fully connected between the strut and the rotating bed.

23. The method of claim 18 wherein the jib comprises a luffing jib pivotally attached to the boom, and the jib rigging can be used to change the angle of the luffing jib with respect to the boom.

* * * * *